United States Patent [19]

Comfort

[11] Patent Number: 4,534,065

[45] Date of Patent: Aug. 13, 1985

[54] BLANKET GARMENT WRAP

[76] Inventor: Gloria N. Comfort, 315 Laurel Dr., LaFayette, Ga. 30728

[21] Appl. No.: 575,272

[22] Filed: Jan. 30, 1984

[51] Int. Cl.[3] ..... A41D 3/00

[52] U.S. Cl. ..... 2/69.5; 428/100; 428/194

[58] Field of Search ..... 428/100, 192, 194; 2/69.5

[56] References Cited

U.S. PATENT DOCUMENTS

| | | | |
|---|---|---|---|
| 906,551 | 12/1908 | Newman | 2/69.5 |
| 3,013,274 | 12/1961 | Dike | 2/69.5 |
| 4,142,264 | 3/1979 | Whiting | 5/334 R |
| 4,363,141 | 12/1982 | Doster | 2/69.5 |

*Primary Examiner*—Alexander S. Thomas

*Attorney, Agent, or Firm*—Pahl, Lorusso & Loud

[57] ABSTRACT

The disclosed invention is a blanket/comforter of the type designed to be wrapped about one's legs. In the disclosed embodiments, strips of VELCRO-type fastener material extend along the entire length of one edge, on the interior side of the blanket and include a relatively long length of VELCRO hook or loop material and a relatively short length of VELCRO material for mating with the longer length. On the opposite (exterior) side of the fabric the same type VELCRO material is provided along the relatively shorter length of the fabric. In this manner, a first fold brings the shorter length of VELCRO fastener material into locking engagement with a portion of the longer length of fastening material. In making the second fold, the remaining length of the longer strip of fastening folds over and locks with the shorter strip of fastening material provided on the exterior side of the fabric. Another edge of the blanket is provide with additional strips of VELCRO-type material and, upon making the second fold, is brought into locking engagement with mating strips of VELCRO fabric located on the reverse or outer side of the blanket, intermediate with edges of the blanket. Preferably, the interior surface of the blanket is provided with a fleece liner which defines a pocket for insertion of an electric heating pad.

5 Claims, 5 Drawing Figures

BLANKET GARMENT WRAP

SUMMARY OF THE INVENTION

The main body of the blanket of the present invention may be a conventional quilt-type material which will typically have a decorative print on at least its exterior side with a filling material between the quilted exterior and underside fabrics. Alternatively, the main body of the blanket of the present invention may be of any conventional material used for blankets.

It is the object of the present invention to provide such a blanket with a series of cooperating, fastening elements so that the blanket may be wrapped around a user's body or legs by making two folds to form a tube-like or bag-like structure open at its upper end for insertion of the legs.

In accordance with the present invention, the edge of the blanket which serves to form the lower, closed end of the tube, formed by making the two folds, is provided with a strip of a first type of VELCRO material extending along a major portion of its length on one side of the blanket and with strips of a second type of VELCRO material, for mating and locking with the first, extending along its remaining length, on both sides of the fabric. Thus, upon making a first fold at the point where the two different types of VELCRO material meet, the two different type strips located on the interior surface of the fabric are brought into locking engagement. Because the one strip is longer, after making the first fold a second fold may be made to bring the remainder of the longer fastening strip over and into locking engagement with the shorter strip on the exterior side of the blanket, thus completing the closure at the bottom of the bag or tube. Additional strips of VELCRO fastening material are provided on one edge of the fabric running from top to bottom of the tube (in use), which fastening means mates with additional strips of VELCRO material provided on the reverse or exterior side of the fabric intermediate the two longitudinal edges, thus closing the longitudinal edge of the tube or bag.

In a preferred embodiment, a fleece liner is provided on the inside surface of the blanket and is sewn thereto in a manner to define a pocket for receiving and holding a heating pad.

Use of the blanket of the present invention, wrapped around one's legs, allows for regulation of body temperature within the comfort zone even if the room temperature is considerably lower. The provision for use of a heating pad, in combination with the blanket, further enhances the warming effect.

DESCRIPTION OF THE PREFERRED EMBODIMENTS

Figure 3:
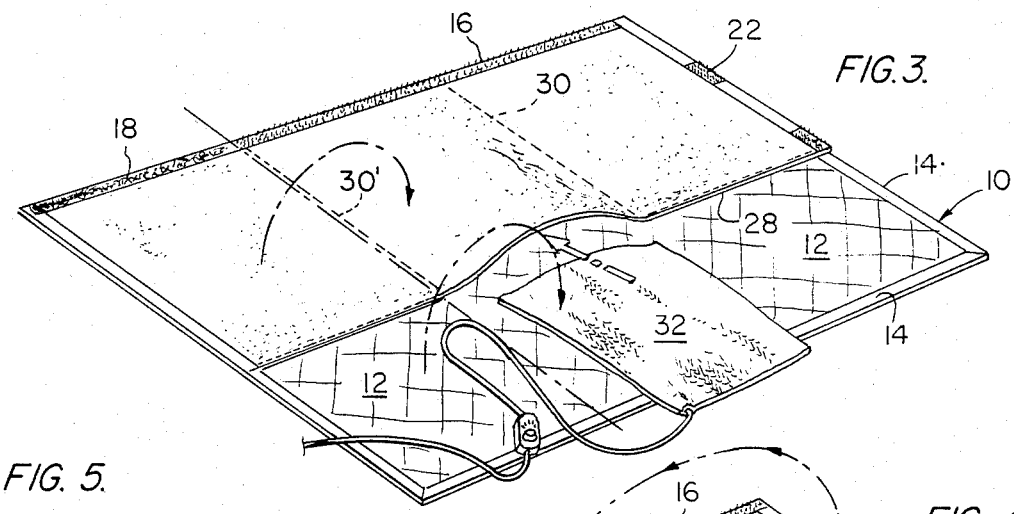
FIG. 3 is a schematic view showing the interior surface of the blanket and indicating the manner in which a heating pad is inserted into the blanket of the invention and the manner in which the first fold is made in coverting the blanket to a garment wrap.
Figure 5:
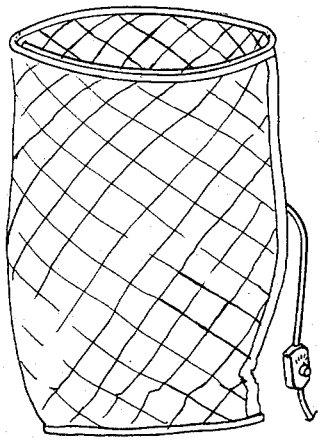
FIG. 5 is a schematic view of the completely formed garment wrap after both folds have been made.
Figure 4:
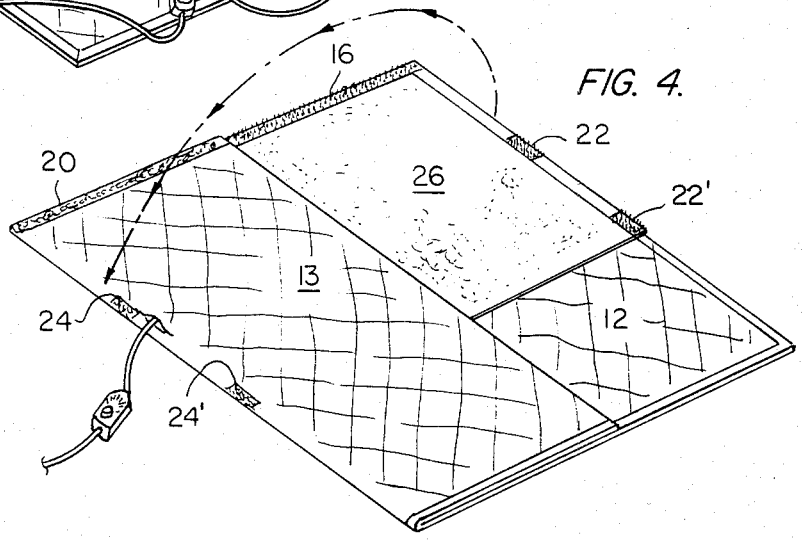
FIG. 4 is a schematic view of the blanket after the first fold has been made and indicating the manner in which the second fold is made.

With reference to the drawings, the blanket of the present invention is generally designated by the reference numeral 10. The main body of the blanket is in the form of a quilt 12 having its four edges bound by a strip of cloth 14 sewn thereto. As is best seen in FIGS. 3 and 4, the blanket is provided with a plurality of fabric fastener strips of the hook and pile type sold under the trademark VELCRO. As seen in FIG. 3, a first fastener strip extends along one edge of the fabric and includes a length of hook fabric 16 and a length of loop fabric 18, both sewn on top of border strip 14 on the interior surface 12 of the blanket. As seen in FIG. 4, the reverse (exterior) side 13 of the fabric is provided with a second fastener strip 20 in the form of VELCRO loop material identical to strip portion 18 and running along the same length of the border strip 14 as strip 18 but on the opposite side thereof. A third fastener in the form of strips 22, 22' of VELCRO hook fabric is provided at an interior edge of the fabric perpendicular to that carrying VELCRO strips 16 and 18 and strips 24, 24' of VELCRO loop fabric are provided on the opposite (exterior) side of the fabric, for mating with strips 22 and 22' at a point intermediate the edges of the fabric perpendicular to strips 16 and 18. These fasteners, in combination, allow the blanket to be folded twice and each fold to be secured to form a tube as shown in FIG. 5 and as shown wrapped around a person's legs in FIGS. 1 and 2. To facilitate retaining the two folds, strip 16 extends approximately two-thirds ($\frac{2}{3}$) of the length of the blanket and strip 18 extends over approximately the remaining one-third ($\frac{1}{3}$) of the fabric length. Accordingly, approximately one-third ($\frac{1}{3}$) of the blanket can be folded over the center of the blanket as shown in FIGS. 3 and 4 with strip 18 engaging and being held by approximately one-half ($\frac{1}{2}$) of the length of strip 16. VELCRO loop strips 24 and 24' are located adjacent the fold line formed by making the first fold, as indicated in FIG. 3 and as shown completed in FIG. 4. The right-most (as shown in the drawing figures) third of the fabric can then be folded over the central portion of the fabric as indicated by the arrows in FIG. 4 to form the tube shown in FIG. 5. In making the second fold, as depicted in FIG. 4, strips 22 and 22' are brought into engagement with and lock with strips 24 and 24'. Likewise, upon making the second fold as depicted in FIG. 4, the remaining unengaged portion of VELCRO hook strip 16 is brought into engagement with and locks with the VELCRO loop strip 20 located on the same edge, but on the exterior surface of the blanket.

Figure 1:
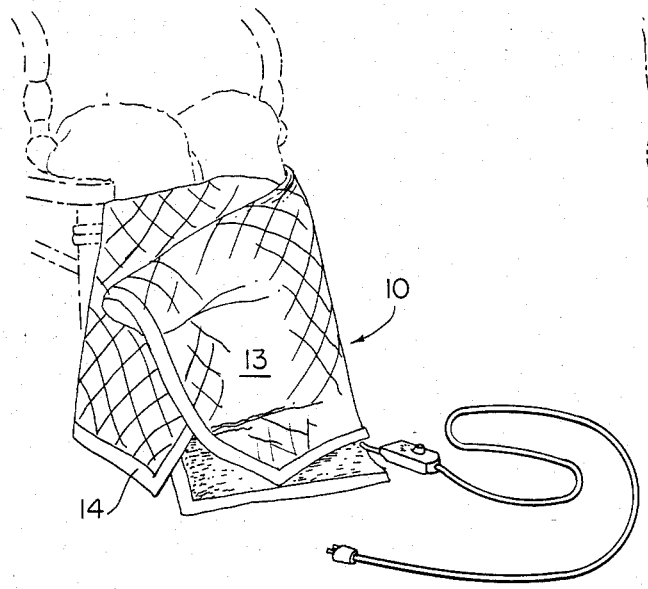
FIG. 1 is a schematic view showing use of the blanket of the present invention as a garment.
Figure 2:
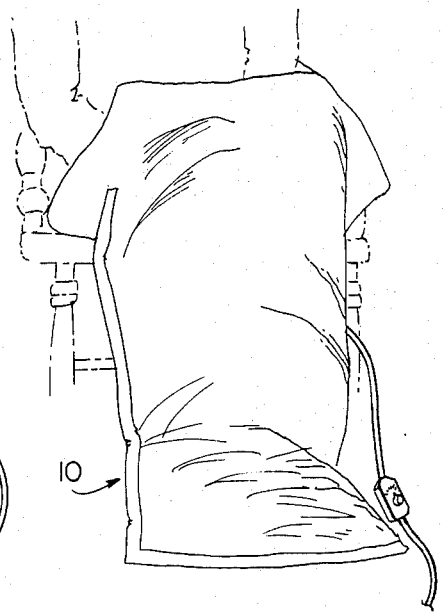
FIG. 2 is a schematic view showing use of the blanket of the present invention as a garment similar to FIG. 1, but without the top folded down.

After the tube is formed, one may insert his or hers legs into the tube for warmth as shown in FIG. 2. Alternatively, the tube may be formed by wrapping around the legs. If desired, the top portion of the tube which remains unfastened, can be folded down as shown in FIG. 1 to provide warmth only for the lower legs.

As seen in FIGS. 3 and 4, the side 12 of the blanket intended to form the inside of the tube is further provided with a liner of a fleece material 26 which extends over 40 to 80% of the length of the fabric, most preferably over about two-thirds ($\frac{2}{3}$) of the fabric. The edge 28 of the fleece liner, which will be the upper edge in use, is sewn inwardly from the edges of the blanket but is left unstitched across the central portion of the fabric to provide an opening for insertion of a heating element, for example, the electric heating pad 32 shown in the drawings. Optionally, further stitching may be provided at 30 and 30' to better hold the heating pad 32 in place.

As noted above, the preferred fasteners are strips of VELCRO material and the terminology "hook and pile" is used herein to describe fabric fasteners of the VELCRO type. However, other types of fasteners, such as conventional snap fasteners, could likewise be used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to embrace therein.

I claim:

1. A blanket for wrapping into a closed tube about a person's legs or body, said blanket having:

on a first side of the blanket, a single continuous strip of a first type of VELCRO material extending along approximately $\frac{2}{3}$ of the length of one edge and a single continuous strip of a second type of VELCRO, for mating with said first type material, extending along the remaining length of said one edge;

on the opposite side of said blanket, a single continuous strip of said second type of VELCRO material extending along said remaining length of said one edge;

first fastening means extending along a second edge on said first side of said blanket, approximately perpendicular to said one edge; and second fastening means, for mating with said first fastening means, located on said opposite side of said blanket, extending along a line approximately perpendicular to said first edge and located at a sufficient distance from the blanket edges parallel thereto to allow the blanket to be folded into three panels of substantially equal size with mating of said third and fourth fastening means.

2. A blanket in accordance with claim 1 further comprising a liner sewn to one side of said blanket.

3. The blanket of claim 2 wherein said liner is sewn to define a pocket for holding heating means, said pocket opening toward the edge of said blanket opposite said first edge.

4. The blanket of claim 3 wherein said pocket is substantially narrower than the width of the blanket.

5. The blanket of claim 2 wherein said liner is a fleece material and extends from said first edge and covers 40–80% of the blanket.

* * * * *